United States Patent [19]

McAlister

[11] 3,942,472

[45] Mar. 9, 1976

[54] PAINT GUIDE APPARATUS

[76] Inventor: Edgar O. McAlister, 9810 E. Broadway, Tucson, Ariz. 85710

[22] Filed: Jan. 2, 1975

[21] Appl. No.: 538,005

[52] U.S. Cl. ..... 118/504

[51] Int. Cl.[2] ..... B05C 11/00

[58] Field of Search ..... 118/505, 504, 301

[56] References Cited

UNITED STATES PATENTS

| | | | |
|---|---|---|---|
| 2,545,638 | 3/1951 | Wheatley | 118/504 |
| 3,434,458 | 3/1969 | Huff et al. | 118/301 |
| 3,584,599 | 6/1971 | Chastain | 118/301 |
| 3,633,536 | 1/1972 | Morrison | 118/301 |

*Primary Examiner*—Morris Kaplan

*Attorney, Agent, or Firm*—H. Gordon Shields

[57] ABSTRACT

A paint guide apparatus is disclosed which includes a continuous length of paper movable through a ratchet mechanism to provide clean paper at a front edge of the guide.

4 Claims, 7 Drawing Figures

PAINT GUIDE APPARATUS

BACKGROUND OF THE INVENTION

1. Field of the Invention

This invention relates to paint guides and, more particularly, to a paint guide which includes paper movable over a front edge of the paint guide to allow clean paper to be at the edge of the paint guide as desired by the user thereof.

2. Description of the Prior Art

One of the more important problem areas in painting is the juncture of walls and ceilings or the juncture of other areas between two colors of paint or two kinds of paint. For example, if adjacent walls are to be painted different colors, there is a problem of preventing the paint from one wall to slop or spill over onto the adjacent wall. The same problem is encountered at the juncture of a wall and woodwork, or at the juncture of a ceiling with an adjacent wall, when the two are to be painted different colors. This universal problem is more serious to amateur painters, such as the ordinary homeowner.

There are paint guides in the prior art of several different types. The most popular type is simply a sheet of light metal, such as aluminum or steel, with some type of handle affixed thereto. The paint guide includes a straight edge of 10 to 15 inches which is placed along a wall, wooden molding, or the like, and acts as a barrier between the area being painted and the area which is not to be painted. One of the inherent problems of this type of painting guide is that paint on the edge will invariably work its way by gravity, or by other means, around the edge of the paint guide and onto the protected side of the paint guide and thence onto the adjacent wall where no paint is desired. The solution to this type of problem is simply to wipe off the edge often. The term "often" may mean as frequently as each time the paint guide receives paint from the brush or roller being used by the user. Obviously, this type solution is not acceptable and accordingly this type of paint guide, though in wide use, is certainly not an adequate solution to the problem.

Another type of paint guide is that disclosed in the Wheatley patent, U.S. Pat. No. 2,545,638. The Wheatley patent discloses a roll of paper wound about an edge of a paint guide to allow fresh and clean paper to be advanced to the edge each time the guide, or the paper on the guide, at the edge receives paint. This, of course, prevents the transfer of paint from the guide to the adjacent wall.

The type of apparatus shown in the Wheatley patent has not gained widespread acceptance primarily because of the problem in advancing the paper. Moreover, the method of holding the apparatus does not appear to lend itself to ease of use or to use in a variety of positions, as is necessary in effectively using apparatus of this type.

The apparatus disclosed and claimed herein overcomes the problems of the prior art by presenting clean paper to the front edge of a paper guide in a very easy manner and allows the user to control the angle or position in which the guide is used by a simple adjustment of the handle.

SUMMARY OF THE INVENTION

The invention described and claimed herein is a paint guide with an adjustable handle and with a supply of paper movable over the edge of the paint guide so as to present a supply of clean paper to the edge of the guide by advancing the paper through a mechanical ratchet movement.

Among the objects of the present invention are the following:

To provide a new and useful paint guide apparatus;

To provide a new and useful paint guide apparatus including fresh paper at a front edge of the paint guide;

To provide a new and useful paint guide apparatus having an adjustable handle;

To provide a new and useful paint guide apparatus having a mechanical means for advancing paper disposed about the front edge of the paint guide;

To provide a new and useful paint guide apparatus including a brake for retarding the movement of paper at the working edge of the apparatus; and To provide new and useful paint guide apparatus having the capability of storing paint laden paper.

DESCRIPTION OF THE PREFERRED EMBODIMENT

Figure 1:
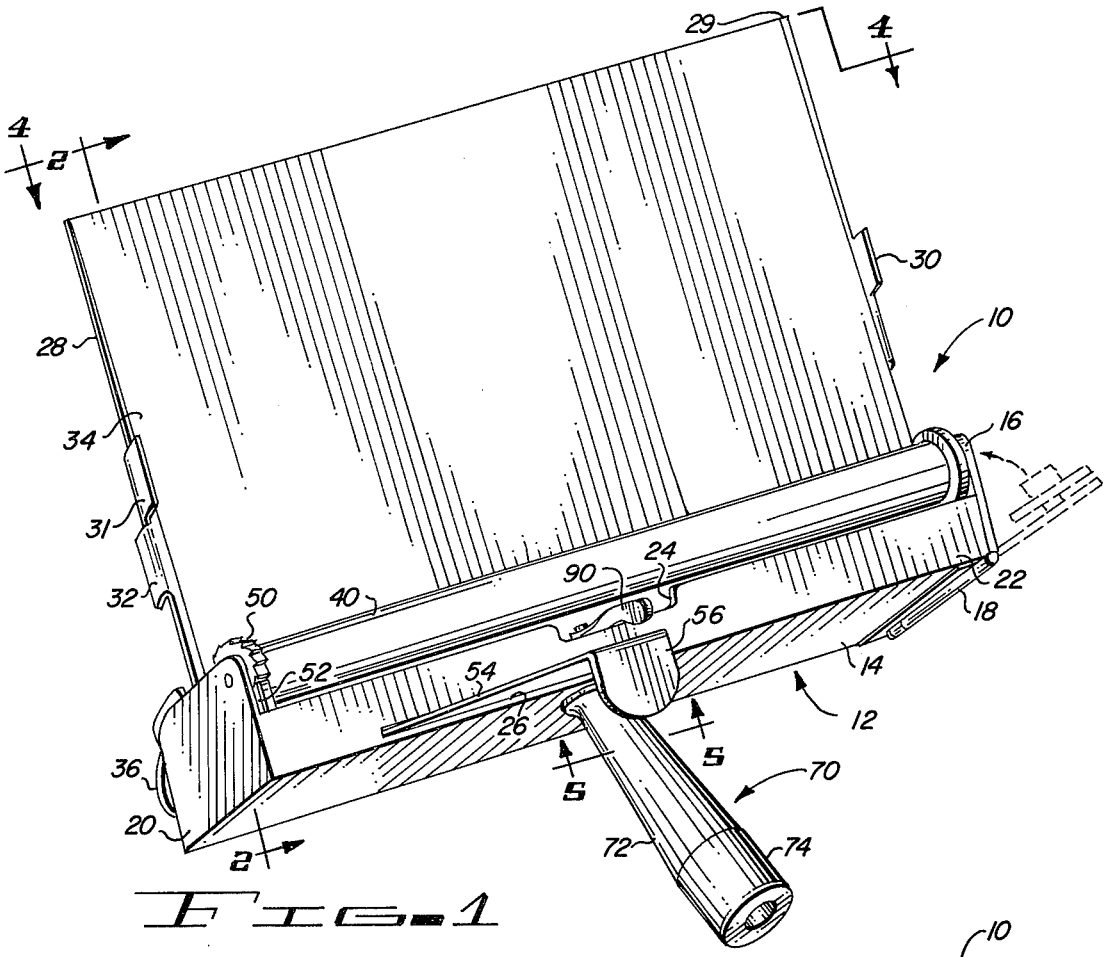
FIG. 1 is a perspective view of apparatus embodying the present invention.

FIG. 1 is a perspective view of paint guide apparatus 10 embodying the present invention. The apparatus 10 includes a roller housing 12, which is preferably made of a strong, lightweight sheet metal. It may also be fabricated of plastic, if desired. The roller housing 12 includes a rear end wall 14 and a movable end wall 16 which is secured to the rear wall 14 by a hinge 18. At the opposite end of the rear wall 14 from the movable end wall 16 is a fixed end wall 20, appropriately secured to the rear wall 14. The end walls are disposed substantially perpendicular to the rear wall 14. The movable end wall pivots on the hinge 18 to allow a supply of paper to be removed from the apparatus or to be replaced as necessary. The apparatus 10 also includes a paper supply holder 36 and a takeup roller 40.

The pivoting action of the movable end wall 16 is illustrated in FIG. 1 by the phantom drawing showing the movable end wall in its open position.

A top cover 22 extends between the rear wall 14 and the end walls 16 and 20. The top cover 22 is secured both to the rear wall 14 and to the fixed end wall 20. A pair of slots, 24 and 26, are cut into the top cover. The slots receive respectively a brake release lever 90 and a ratchet actuator lever 54. The function of the levers will be described in detail below.

Secured in approximately the center of rear wall 14 is a handle 70. The handle 70 is essentially in two pieces, a grip 72 and a locking end cap 74. The handle 70 is adjustable to a plurality of positions on the rear wall 14, as will be explained and discussed below in conjunction with FIGS. 5 and 6.

A blade 28, generally rectangular in configuration, is secured to rear wall 14 and extends outwardly therefrom. The blade is substantially perpendicular to the rear wall and is disposed between the paper supply holder 36 and the takeup roller 40. The blade includes an outer or front edge 29.

A pair of guide tabs 30 and 31 are shown extending upwardly from the blade 28 at its side edges. Another guide tab, guide tab 32, is shown extending downwardly from one of the side edges of the blade.

A supply of paper 34 is shown disposed over the blade 28 and extending between the guide tabs. The paper is stored in the paper supply holder 36 and extends outwardly to and around the front edge of the blade. The paper is secured to the paper takeup roller 40. The roller 40 is moved by the ratchet actuator lever 56 to advance the paper, as will be explained in detail below. The advancing of the paper results in clean paper at the front edge of the blade and in storage of the soiled, paint laden paper on the paper takeup roller.

Figure 2:
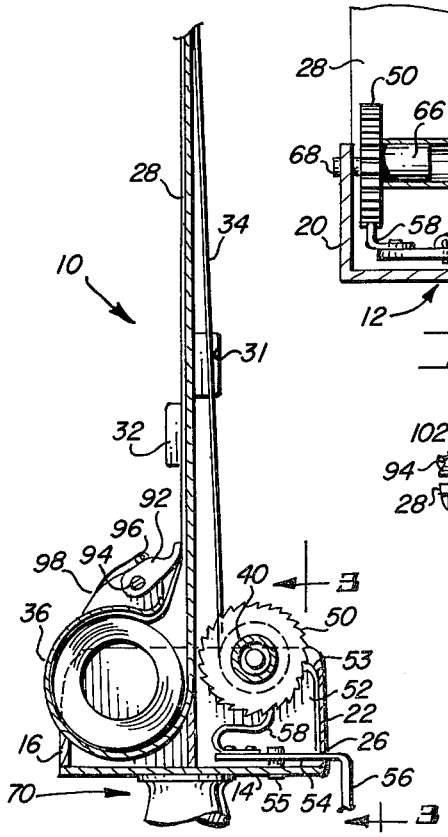
FIG. 2 is a view of a portion of the apparatus of FIG. 1 taken generally along line 2—2 of FIG. 1.

FIG. 2 is a view of a portion of the apparatus of FIG. 1, taken generally along line 2—2 of FIG. 1. It illustrates the paper advance mechanism and the paper brake mechanism which cooperates with the paper advance mechanism to keep the paper 34 taut over the edge of the blade 28. The blade 28 in FIG. 2 is shown broke, so as to eliminate the edge of the blade. This allows the complete description of the paper takeup mechanism, the paper brake, and the blade, with the paper extending around the blade, to be illustated in detail.

The blade 28 extends substantially perpendicular to the rear wall 14. In FIG. 2, the fixed end wall 20 has been removed so as to show clearly the mechanism adjacent the fixed end wall 20, such as the ratchet gear 50, and its allied elements which will be discussed in detail. The handle 70 extends outwardly from the rear wall 14 substantially opposite the blade 28. Movable end wall 16 is also shown in FIG. 2.

Paper 34 is provided from a supply in the form of a roll disposed in paper supply holder 36. From the paper supply holder 36 the paper extends outwardly on one side of blade 28 between a pair of guide tabs, of which only guide tab 32 is shown in FIG. 2. The paper 34 moves over the end or outer edge of the blade 28 and extends along the opposite, or top side of blade 28 between another pair of guide tabs, of which only guide tab 31 is shown in FIG. 2. The paper is secured to the takeup roller 40 which extends between the movable end wall 16 and the fixed end wall 20. (See FIG. 1.) The takeup roller 40 preferably is slotted to receive a portion of the end of paper 34. The paper, after extending through a slot in the takeup roller, will stay on the roller thereafter by the frictional engagement between the roller and the paper and by successive layers of paper wound about the takeup roller as the roller is moved.

To advance the paper from the paper supply holder 36 on the takeup roller 40, a ratchet gearing mechanism is provided. The mechanism includes a ratchet gear 50, which is simply a gear with a plurality of teeth disposed at the outer periphery of the gear. The teeth are preferably relatively cose together so as to provide small incremental rotary movement of the takeup roller in response to movement of the ratchet actuator lever 54. By pressing downwardly, with respect to FIG. 1, or in the direction of the top cover 22, on the thumb arm 56 of the ratchet actuator lever 54, an engagement is made between a spur 58 and a tooth or cog on the ratchet gear 50. The lever 54 pivots about a pivot point, which comprises a rivet or pin 55 or the like, secured to the end wall 14 and disposed between the arm 56 and the spur 58. Accordingly, as the thumb arm 56 of the ratchet actuator lever 54 moves downwardly or toward the top cover 22, the opposite end of the ratchet actuator lever 54, that portion or end which includes the spur 58, moves upwardly, also toward top cover 22. This movement results in an engagement between the spur 58 and the cogs or teeth on the gear 50. As the upward movement of spur 58 continues, the ratchet gear 50 accordingly moves an incremental distance, carrying the takeup roller 40 therewith since the ratchet gear is secured to the takeup roller. When the takeup roller moves, the paper 34 secured thereto also moves over the end of blade 28 and onto the takeup roller 40. In this manner, there is a small incremental movement of the paper on the blade as desired to provide fresh paper at the tip of the blade for continued painting.

Movement of the ratchet gear 50 and accordingly of the takeup roller 40 secured thereto, in the opposite direction from that urged by spur 58, is prevented by a ratchet stop 52. The ratchet stop 52 is a fixed member or element secured to top cover 22 and it includes an end portion or spur 53 which extends downwardly and engages the gears or cog of the ratchet gear 50. The end portion or spur 53 is designed so as to allow the ratchet gear 50 to move in one direction only, and to oppose and prevent movement of the ratchet gear in the opposite direction. In this manner the takeup roller 40 is allowed to move in one direction only, to take up the paper wound about the roller, and to prevent any movement which would allow the paper on the roller to move in the opposite direction. Movement in the opposite direction would allow the paint laden paper wound about the takeup roller to become loose.

The paper 34 is kept taut over the blade 28 by means of brake apparatus which is spring biased against the paper adjacent the paper supply holder 36. The brake apparatus includes a brake flange 92 extending substantially the entire width of blade 28, which is substantially the width of the paper 34. The brake flange 92 is secured to a rod 94 which extends between the ends of the paper supply holder 36. The brake flange is allowed to pivot on the rod 94 and is spring biased by a pair of coil springs, (not shown in FIG. 2) which are a typical, well-known type coil spring, extending about the rod 94 and exerting a bias between the paper supply holder and the brake flange.

Through the bias of the brake flange against the paper, the paper is kept taut about the blade 28 as it is advanced on the paper takeup roller 40 by the ratchet apparatus discussed above. The bias of the brake flange may be released by the brake release lever 90 (see FIG. 1) which pivots on a pin or rivet, similar to the pivoting action of the ratchet lever 54 about rivet 55. The brake release lever is connected to a wire 98 which in turn is connected to a pin 96 secured to the brake flange 92. When the brake release lever 90 (see FIG. 1) is pivoted, the movement of the lever is transmitted through wire 98, and through pin 96, to move brake flange 92 against the bias of the coil springs which results in the pivoting of the brake flange on its rod 94. In this manner, the brake flange 92 is moved out of engagement with the paper 34. The pin 96 extends outwardly from the brake flange and provides a moment arm for rotating or pivoting the flange.

Figure 3:
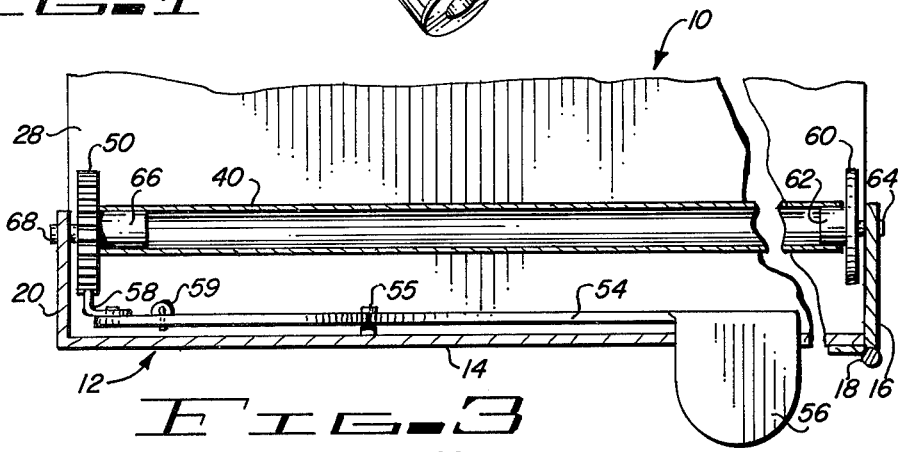
FIG. 3 is a view of the apparatus of FIGS. 1 and 2 taken generally along line line 3—3 of FIG. 2.

FIG. 3 is a view of the apparatus of FIG. 2 taken generally along line 3—3 of FIG. 2, and it comprises a view in partial section, and partially broken away, of the apparatus of FIGS. 1 and 2. The view illustrates the operation of the paper takeup roller 40 and the ratchet apparatus which moves the paper takeup roller.

Movable end wall 16 includes a support 60 secured thereto. The support is a generally circular disc or wheel which includes an insert extending inwardly, or toward the center of the paint guide apparatus, and is received within one end of the takeup roller 40. The insert is of the same configuration and inside dimension as the takeup roller 40. The support 60 is secured to the end wall 16 by appropriate fastening means, such as pin or rivet 64. If desired, the support may be journaled for rotation on the pin or rivet 64 through the end wall 16. At the opposite end of the takeup roller 40 from the movable end wall 16, the ratchet gear 50 is journaled for rotation on the fixed end wall 20. The ratchet gear 50 also includes an insert 66, which is substantially the same as the insert 62 with respect to the inside configuration and dimension of the takeup roller 40. The insert 66 extends inwardly from the ratchet gear and is received into the opposite end of takeup roller 40 from the insert 62. The ratchet gear 50 is journaled for rotation on end wall 20 by appropriate fastening means, such as pin or rivet 68.

Downward movement, with respect to FIGS. 1 and 3, on thumb arm 56 of the ratchet actuator lever 54, results in movement of the ratchet actuator lever 54 about its pin or rivet 55 which is secured to the rear wall 14 of roller housing 12. As the thumb arm 56 moves downwardly, the spur 58 on the opposite end of ratchet actuator lever 54 from the thumb arm moves upwardly to engage the spurs or cogs on the outer periphery of the ratchet gear 50. The engagement of the spur with the gear results in movement of the gear and that movement is transmitted to the paper takeup roller 40. Movement of the takeup roller 40 in turn results in movement of paper 34, which is secured thereto, as discussed above.

The lever 54 is biased downwardly between the rivet 55 and the spur 58, which biases the lever 54 upwardly between the rivet and the thumb arm 56, by a spring 59 secured to the lever and to the end wall 14.

Figure 4:
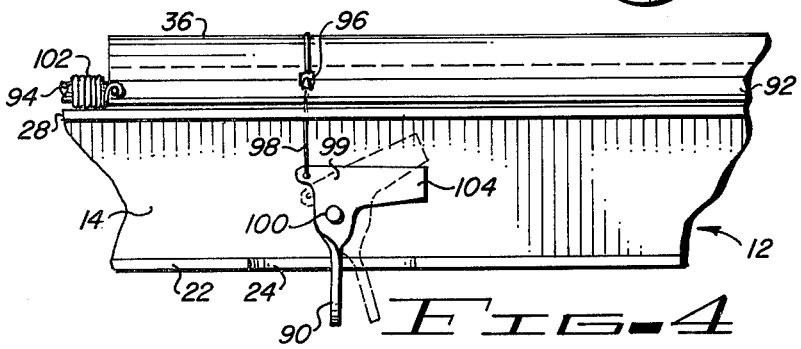
FIG. 4 is a view, partially broken away, illustrating the brake mechanism included in the present invention.

FIG. 4 is a broken view of a portion of paint guide apparatus 10, illustrating the operation of the paper brake and the brake release apparatus. A portion of the roller housing 12 is shown in FIG. 4, including an edge view of top cover 22 and a side view of rear wall 14. Blade 28 is shown on edge.

Brake release lever 90 is secured to rear wall 14 by appropriate fastening means, such as pin or rivet 100. The brake release lever pivots about the pin or rivet 100 in response to pressure applied to the brake release lever. The pivoting is shown in phantom. The lever extends outwardly from the roller housing 12 through a slot 24 in top cover 22. Wire 98 is secured to an arm 99 of the brake release lever 90. The wire extends from the arm through an opening or aperture, not shown, in blade 28 and thence around the exterior periphery of paper supply holder 36 to pin 96 secured to brake flange 92. Accordingly, pressure applied to brake release lever 90 to pivot the lever to the position shown in phantom in FIG. 4 results in a tension force applied through arm 99 of the lever 90 to wire 98. The tension force is transmitted through the wire to the pin 96 secured to the brake flange 92. The force in turn results in a movement of the brake flange 92 against the biasing force of a coil spring 102 or rod 94. The spring 102 is, as discussed above, a coil spring extending about rod 94 between the brake flange 92 and the paper supply holder 36. The brake flange 92 is carried on the rod 94 and is pivotally secured thereon. The bias of spring 102 extending between the paper supply holder 36 and the brake flange 92, urges the brake flange into contact with paper disposed on the blade 28 and extending between the paper supply holder 36 and the takeup roller 40 (not shown in FIG. 4, but see FIGS. 1, 2 and 3).

The movement of the brake flange away from engagement with the paper disposed on blade 28 is limited by movement of brake lever 90. Brake lever 90 is only able to move until end 104 of the arm 99 contacts the blade 28. Accordingly, the length or configuration of arm 99 and its end 104, and the positioning of pin or rivet 100, both with respect to blade 28, limit the extent to which the brake flange 92 moves away from blade 28 and against the biasing urge of spring 102. As discussed above, the pin 96 extends outwardly from the brake flange to provide a movement arm for pivoting the flange wire 98, which is secured to the outer end of the pin 96.

Figure 5:
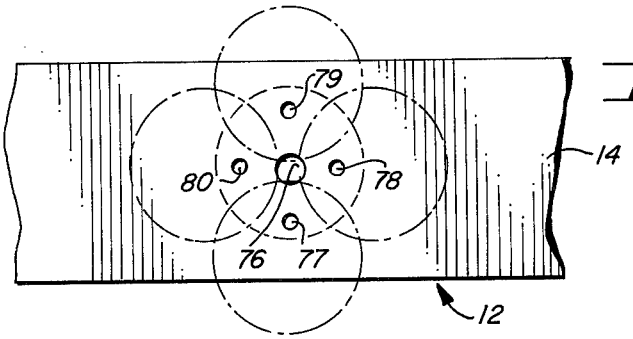
FIG. 5 is a view, partially broken away, of a portion of the apparatus of FIG. 1 taken generally along line 5—5 of FIG. 1 and illustrating the positioning of the handle.
Figure 6:
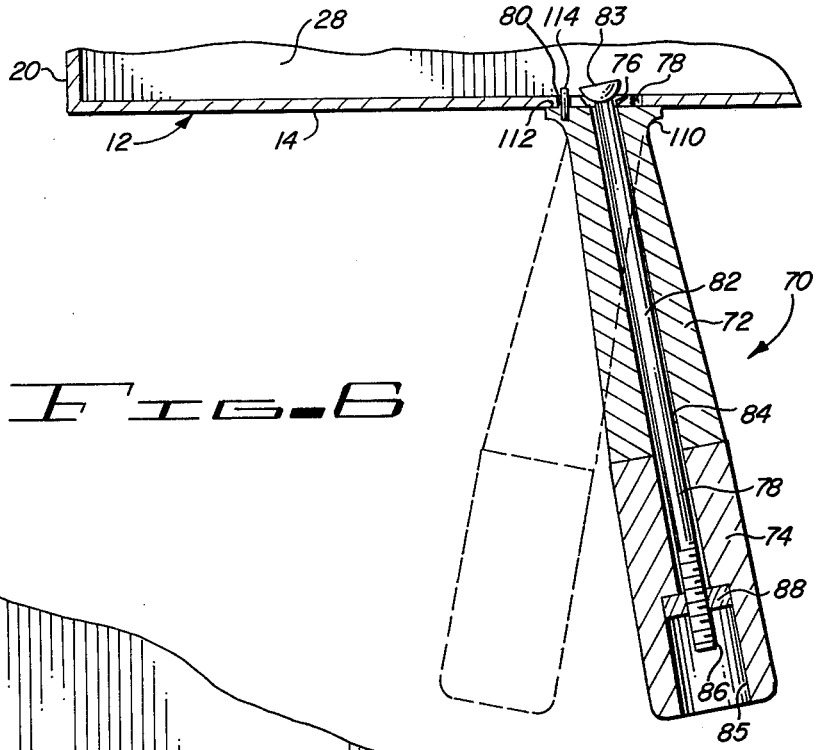
FIG. 6 is a view, partially broken away, of the handle apparatus of the present invention.

FIG. 5 is a view, partially broken away, of a portion of the apparatus of FIG. 1 taken generally along line 5—5 of FIG. 1. The figure illustrates the positioning of the handle for ease of use of the paint guide apparatus. The rear wall 14 of roller housing 12 is illustrated in a fragment thereof. An aperture 76 extends through the rear wall, and equally spaced from each other and at the same radial distance from aperture 76, is a plurality of smaller apertures, apertures 77, 78, 79, and 80. The holes or apertures 77 . . . 80 are smaller than the aperture 76 and serve to receive a pin disposed on the face of the handle, as illustrated in FIG. 6. The dotted lines in FIG. 5 illustrate the position of the end of handle 70 (see FIGS. 1, 6, and 7) when the handle is positioned with its guide pin in each of the apertures 77 . . . 80.

FIG. 6 illustrates the actual positioning of the handle 70 and may be viewed in conjunction with FIG. 5. FIG. 6 is a view in partial section and partially broken away, of the handle apparatus 70 showing the operation of its respective parts with the end wall 14 of roller housing 12. In FIG. 6 is shown the rear wall 14 and the fixed end wall 20 of roller housing 12. Blade 28 is also shown extending outwardly from the roller housing.

The handle 70 includes two separate portions, a grip portion 72 and a locking end cap portion 74. A bore 84 extends axially through both the grip 72 and the locking end cap 74. The handle is generally symmetrical axially and accordingly the bore is centrally located within the handle. Within the locking end cap 74 of the handle is a counterbore 85, which is concentric with bore 84. A rod 82 extends through the bores 84 and 85. The rod 82 includes a head 83 on one end and a threaded portion 86 on its opposite end. The head is preferably hemispherically configured, with the concave portion adjacent the aperture 76. The rod 82 extends through aperture 76 in the rear wall 14 of the roller housing, and the head 83, whose diameter is greater than that of the aperture 76, prevents the rod from moving through the rear wall 14. The head 83 is generally symmetrical with the axis of the rod 82. The head serves as a stop and as a locking means for securing the handle to the roller housing.

Within the counterbore 85 is disposed a nut 88 which is threaded to rod 82. The counterbore may be appropriately designed so as to hold the nut 88 to prevent relative rotation between the nut and the locking end cap 74. The nut 88 will accordingly move with the end cap.

The handle 70 includes a base 110 at its end opposite that of locking end cap 74. The base 110 is not perpendicular to the axis of the handle, but rather is disposed at an angle of about fifteen to twenty degrees with respect thereto. The base includes a generally flat face 112 which is disposed against the rear wall 14. The base 110 includes a pin 114 extending outwardly from the face 112 substantially perpendicular thereto. The diameter of pin 114 is slightly less than the diameter of each of the plurality of holes 77 . . . 80 (see FIG. 5). As shown in FIG. 6, pin 114 extends through hole 80.

When locking end cap 74 is rotated counterclockwise, as illustrated in FIG. 6, the nut 88 will be screwed off the threads 86 of the rod 82, thus allowing the handle 70 to move outwardly with respect to the roller housing 12. Head 83 will, however, prevent the complete separation between the handle 70 and the end wall 14 of the roller housing unless there is a complete disengagement between the nut 88 and the threads 86 of the rod 82. When the end cap has been loosened sufficiently to allow the grip 72 to move outwardly or away from the rear wall 14 to provide for the withdrawal of pin 14 of the base 110 from the aperture 80, the grip 72 may be rotated to position the pin 114 in any of the holes 77 . . . 80 (see FIG. 5) as desired. Since the face 112 of base 110 is cut at an angle with respect to the axis of the handle 70, the handle will then be disposed at an angle with respect to the rear wall 14, according to the location of pin 114 in the respective holes. If the pin 114 is located in hole 78, by rotating the grip 72 and the locking end cap 74, the handle would be positioned as shown in phantom in FIG. 6. The handle may then be locked in such position by moving the locking end cap in a clockwise direction, as shown in FIG. 6, to screw the nut 88 onto the threads 86 of the rod 82. When the nut threadedly engages the rod, tension is applied between the handle and the rear wall 14 by means of the engagement of head 83 of the rod 82 and the wall 14. This tension will then result in the securing or locking of the handle in place.

Figure 7:
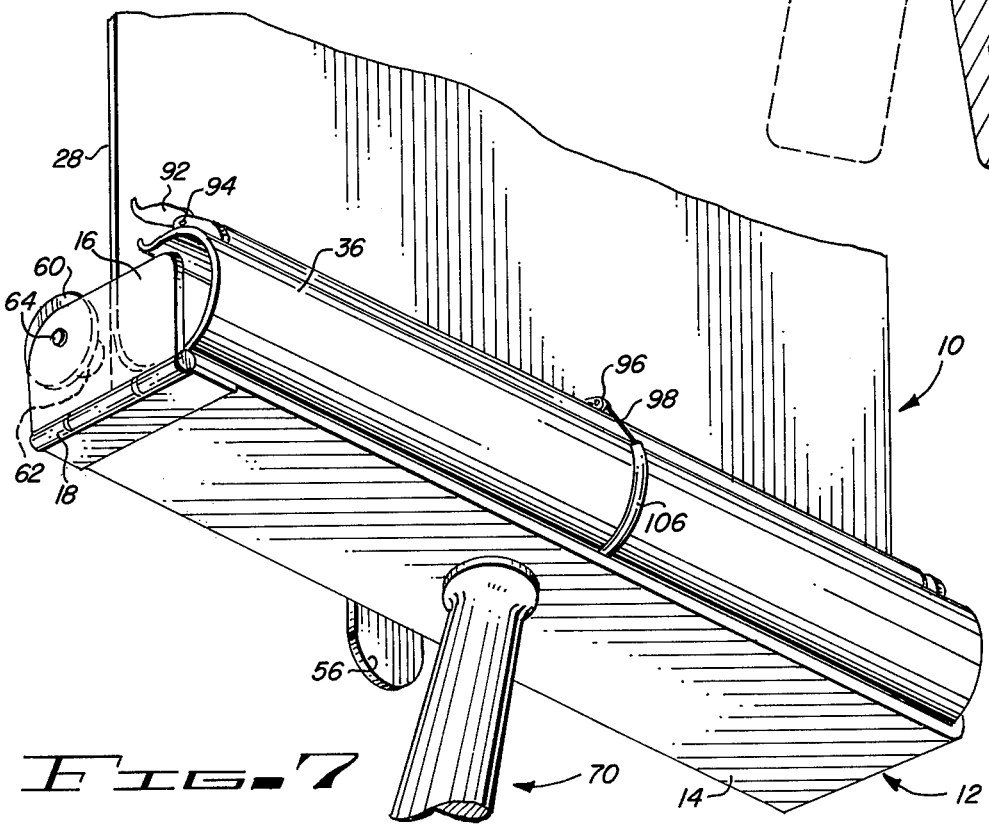
FIG. 7 is a perspective view of the apparatus of FIG. 1, illustrating the apparatus of FIG. 1 from a view reverse that shown in FIG. 1.

FIG. 7 is a perspective view of the paint guide apparatus 10 viewed substantially the reverse from the view shown in FIG. 1. Roller housing 12 is illustrated from the bottom portion, including the rear wall 14 and the movable end wall 16 which is secured to the rear wall by hinge 18. Paper supply holder 36 is shown in FIG. 7, also secured to rear wall 14.

Handle 70 extends outwardly from the rear wall 14 of the roller housing 12. Thumb arm 56 of the ratchet actuator lever 54 (see FIGS. 1, 2, and 3) is also shown in FIG. 7 as extending outwardly from the roller housing 12. Blade 28 is shown extending away from the rear wall 14 in the opposite direction from the handle 70.

The circular support 60, with its insert 62, is shown, partially in phantom, as secured to movable end wall 16 by appropriate fastening means, such as rivet 64. The purpose of the support and its insert has been discussed above, primarily in conjunction with FIG. 3. A takeup roll or roller is axially aligned with the support 60, and the insert 62 aids in supporting and holding the takeup roll between the respective ends of the roller housing.

Brake flange 92 is secured to the paper supply holder 36 by means of a rod 94. The brake flange 92 is movable by a pivoting action on the rod 94. The movement or pivoting of the brake flange away from the paper, against which it is normally biased, is accomplished by means of wire 98 which is secured to a brake release lever, not shown in FIG. 7 (see FIGS. 1, 2, and 4). The wire 98 is secured to a pin 96 on the brake flange 92. The wire 98 is shown as extending through, and protected by, a guide 106, which is disposed on and secured to the paper supply holder 36. The primary purpose of guide 106 is to protect the wire 98.

The paint guide apparatus disclosed above comprises a substantial improvement over the prior art. It is lightweight, easily used, and continually allows fresh paper, such as waxed paper, to be in place at the edge of the blade which protects a desired area from unwanted paint and the like. The paint guide accordingly allows painting of, for example, a wall to a particular corner, to the ceiling, or to wood or trim which is not to be painted, or is to be painted a different color. The adjustable handle allows for rapid and simple change of orientation of the handle to suit the particular use of the paint guide apparatus with respect to the convenience of the user.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Paint guide apparatus having paper movable thereon, comprising, in combination:

roller housing means;

a blade secured to and extending outwardly from the roller housing means and having side edges and a front edge;

handle means adjustably secured to and extending outwardly from the roller housing means oppositely from the blade;

a supply holder connected to the roller housing means on one side of the blade for holding a supply of paper;

a takeup roller in the roller housing means on the other side of the blade to receive paper from the supply holder;

ratchet means connected to the take-up roller to incrementally advance the roller and the paper from the supply holder, around the front edge of the blade, and onto the takeup roller;

brake means disposed against the paper to keep the paper taut around the front edge of the blade;

said ratchet means including a ratchet gear secured to the takeup roller, a spur engaging the ratchet gear, lever means connected to the spur for moving the ratchet gear and the takeup roller, and means for biasing the lever means against movement thereof;

said brake means including a brake flange disposed against the paper and a release lever adjacent the handle means for moving the brake flange away from the paper; and said handle means including a grip, a face on the grip disposed adjacent the roller housing means, a pin extending outwardly from the face, a locking end cap rotatably secured to the grip, and rod means securing the grip and the locking end cap to the roller housing means.

2. The apparatus of claim 1 in which said lever means includes a lever pivotally secured to the roller housing means and having the spur on one end and a thumb arm on the opposite end disposed adjacent the handle means.

3. The apparatus of claim 2 in which the brake means further includes spring means for biasing the brake flange against the paper.

4. The apparatus of claim 1 in which the roller housing means includes a plurality of holes for receiving the pin on the face of the grip of the handle means for orienting the handle means with respect to any one of a plurality of holes on the roller housing means.

* * * * *